US006142314A

United States Patent [19]

Cotterill

[11] Patent Number: 6,142,314

[45] Date of Patent: Nov. 7, 2000

[54] FUSE & LIGHT BULB HOLDER BRIGHT BOX

[76] Inventor: Nigel P. Cotterill, 520 W. Kemper Rd., Cincinnati, Ohio 45246

[21] Appl. No.: 09/413,776

[22] Filed: Oct. 7, 1999

[51] Int. Cl.[7] ..... A47F 7/00

[52] U.S. Cl. ..... 211/26

[58] Field of Search ..... 211/26, 13.1

[56] References Cited

U.S. PATENT DOCUMENTS 1,838,138 12/1931 Einson .
2,903,137 9/1959 Brown .
3,666,113 5/1972 Burrell et al. .
4,026,416 5/1977 Cain .
4,795,121 1/1989 Comito .
4,871,074 10/1989 Bryson et al. .
5,064,067 11/1991 McAllister et al. .
5,279,428 1/1994 Lee .
5,615,780 4/1997 Nimetz et al. .
5,641,075 6/1997 Mechlin .

*Primary Examiner*—Alvin Chin-Shue
*Assistant Examiner*—Sarah Purol
*Attorney, Agent, or Firm*—Patent & Trademark Services; Joseph H. McGlynn

[57] ABSTRACT

A storage rack for storing items such as light bulbs and fuses which has a plurality of horizontal slots which can easily and quickly allow the bulbs to be placed into and removed from the slots. In addition, the slots securely hold the bulbs to prevent accidental breakage and the rack has a resilient back which helps to secure the bulbs. Also, the storage rack has a tray which will hold items that will not fit into the slots.

6 Claims, 1 Drawing Sheet

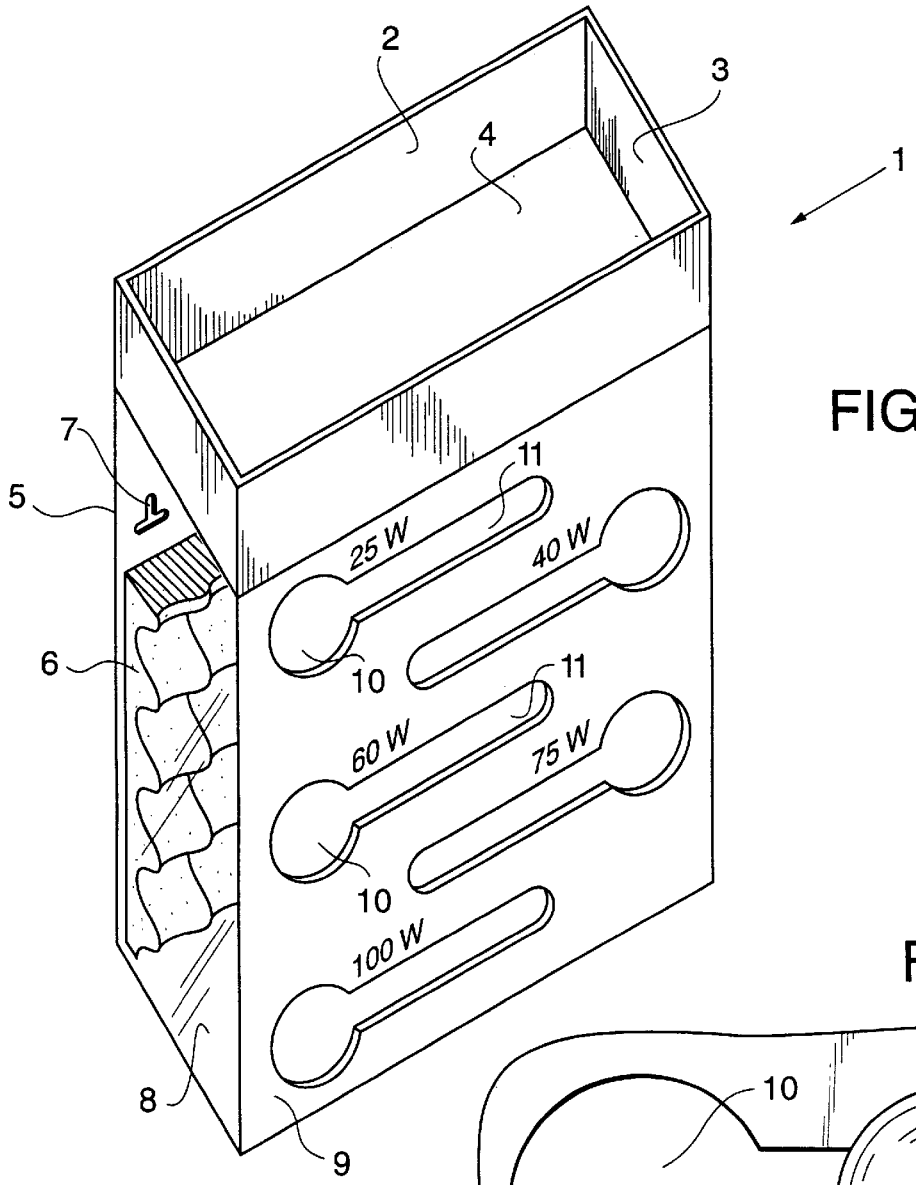
FIG. 1
FIG. 2
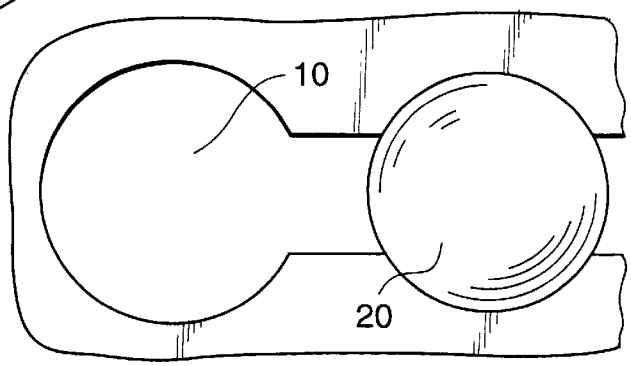
FIG. 3
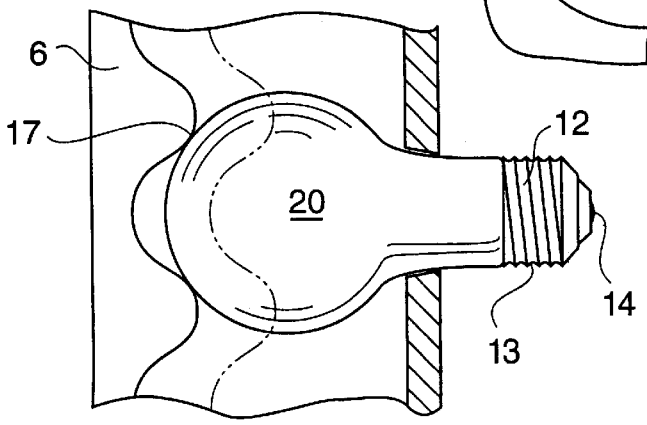
FIG. 4
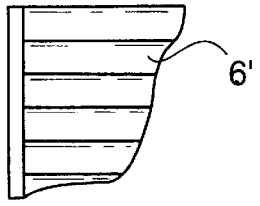

FUSE & LIGHT BULB HOLDER BRIGHT BOX

BACKGROUND OF THE INVENTION

This invention relates, in general, to holders, and, in particular, to a holder for fuses and light bulbs.

DESCRIPTION OF THE PRIOR ART

In the prior art various types of holders have been proposed. For example, U.S. Pat. No. 2,903,137 to Brown discloses a multiple tier utility rack, the top tier of which has wire formed to support the base of light bulbs.

U.S. Pat. No. 4,206,416 to Cain discloses a rack with a series of open recesses to store electric light bulbs with a threaded socket on the back plate of the rack to individually fasten the male threaded base of the stored bulbs.

U.S. Pat. No. 5,064,067 to McAllister et al discloses a Christmas light organizer which has a frame with a plurality of slots arranged along the sides of the frame to receive the cords from a Christmas light string.

U.S. Pat. No. 5,615,780 to Nimetz et al discloses a storage rack with vertical slots to store items such as baby food jars.

SUMMARY OF THE INVENTION

The present invention pertains to a storage rack or holder for storing items such as light bulbs which has a plurality of horizontal slots which can easily and quickly allow the bulbs to be placed into and removed from the slots. In addition, the slots must securely hold the bulbs to prevent accidental breakage.

It is an object of the present invention to provide a new and improved holder or storage rack for items such as light bulbs and fuses.

It is an object of the present invention to provide a new and improved storage rack which will allow bulbs to be placed into and removed from the rack.

It is an object of the present invention to provide a new and improved storage rack which will securely hold the bulbs to prevent accidental breakage.

These and other objects and advantages of the present invention will be fully apparent from the following description, when taken in connection with the annexed drawings.

BRIEF DESCRIPTION OF THE DRAWINGS

FIG. 1 is perspective view of the present invention.

FIG. 2 is a view of the rear side of the front panel of the rack of the present invention showing a bulb inserted into the rack.

FIG. 3 is a partial cross-sectional view of the present invention showing a bulb trapped between the front panel of the rack and the back panel.

FIG. 4 is a partial side view of another embodiment of the pad on the back panel of the rack of the present invention.

DESCRIPTION OF THE PREFERRED EMBODIMENT

Referring now to the drawings in greater detail, FIG. 1 shows the holder or storage rack 1 of the present invention. The rack has a back panel 5 and a front panel 9. The front and back panels are joined together by a tray which is secured to the tops of the front and back panels. The tray has sides 2, ends 3 and a bottom 4. It should be noted that even though the tray is shown as approximately the same size as the rack, it does not have to be this size. For example, the tray can have sides 2 which are longer so that the tray would overhang the sides of the rack. The tray can be used to store items, such as fuses or light bulbs which will not fit into the slots 10, 11 on the front panel 9.

The back panel has a mounting aperture 7 (only one of which is shown) to mount the entire rack onto a vertical surface. The aperture 7 shown in FIG. 1 is the so called "keyhole slot" which has a large aperture communicating with a smaller aperture. This will allow the user to place nails or screws in the vertical surface that the rack will be mounted on. Then when the user wants to mount the rack, he/she places the larger aperture over the head of the nail or screw and moves the rack down until the head of the nail or screw passes into the smaller aperture which will hold the rack on the head of the nail or screw. It should be noted that this type of mounting means is merely for illustrational purposes and any conventional mounting means could be used to secure the rack 1 to a vertical surface.

The front panel 9 will be secured to the back panel 5 by means of the tray and the bottom of the rack 8. The front panel 9, the bottom 8, the back panel 5, and the tray can be secured together using any conventional securing means.

The front panel 9 has a plurality of slots extending therethrough. The number of slots can vary and more or less than the number of slots shown in FIG. 1 can be used without departing from the scope of the present invention. Each of the slots on the front panel 9 will have a large aperture 10 connected to a slot 11 whose width is smaller than the diameter of the aperture 10.

As shown in FIGS. 2 and 3, light bulbs 20 having a conventional base 12 with external threads 13 and a center contact 14, will be secured in the slots 10, 11 by passing the glass envelope 20 of the light bulb through the aperture 10, which will be larger in diameter than the external dimension of the glass envelope 20 of the bulb. The bulb will then be moved downward into the slot 11 to secure the bulb in the slot. The width of the slot 11 should be smaller than the outer dimension of the bulb 20 which will prevent the bulb from being removed from the slot 11 unless the bulb is moved along and into the aperture 10.

In order to further secure the bulbs in the slot 11 and to help prevent breakage of the bulbs 20, a pad 6 is secured to the back panel 5 of the rack in any conventional manner. The pad 6 should be made from a material such as rubber, foam or brushes which has at least a slight amount of resiliency. In addition, the pad 6 should be spaced a distance from the back of the front panel 9 so that the head of the glass envelope 20 will depress the pad 6 slightly, as shown at 17 in FIG. 3, when the bulb is moved along the slot 11. This will hold the bulb securely in the slot 11 and prevent the bulbs from freely moving within the confines of the slot 11. Also, this will help prevent possible breakage of bulbs if one bulb is pushed down into the slot which already holds another bulb. The pad 6 will not allow a second bulb to be moved quickly down the slot and come into contact with a bulb already placed in the slot.

FIG. 4 shows another embodiment 6' of the pad 6. The pad 6 is shown as contoured foam but can be a pad of bristles or brushes 6' or rubber. The contoured foam will provide the resiliency necessary to secure the bulbs without making the pad from a resilient material. In all other respects, the pad 6' will operate in the same manner as the pad 6.

Also, the front panel 9 can have indicia 18 thereon, such as 25 W, 40 W, 60 W, and 100 W, which will indicate the wattage of the bulb in each of the slots.

Although the Fuse and Light Bulb Holder Bright Box and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A storage rack for holding items such as light bulbs, said storage rack comprising:

a front panel and a rear panel, and said rear panel having a resilient pad secured to at least a portion of said rear panel, means for holding said front panel a selected distance from said resilient pad, said front panel having at least one aperire formed therein, said front panel also having at least one slot formed therein, said at least one aperture communicating with said at least one slot, said at least one slot having a width dimension, and said at least one aperture having a width dimension, said width dimension of said aperture being larger than said width dimension of said slot.

2. The storage rack as claimed in claim 1, wherein said rack has a tray attached to an upper portion of said rack, said tray having a pair of sides, a pair of ends and a bottom.

3. The storage rack as claimed in claim 1, wherein said front panel has indicia means associated with said at least one aperture and said at least one slot for indicating the type of item to be secured therein.

4. The storage rack as claimed in claim 1, in combination with a light bulb, and wherein said light bulb has a glass envelope, a base with threads thereon and an end contact secured thereto, said threads having an external dimension, said width dimension of said at least one aperture being larger than said external dimension of said threads, and said width dimension of said at least one slot being smaller than said external dimension of said threads.

5. The storage rack as claimed in claim 4, wherein said light bulb has a length dimension between a rear portion of said front panel and said resilient pad when said light bulb is mounted in said at least one slot, said length dimension of said light bulb is larger than said selected distance between said front panel and said resilient pad.

6. The storage rack as claimed in claim 1, wherein said resilient pad has a plurality of bristles attached thereto.

* * * * *